US011447959B2

(12) United States Patent
Orcutt et al.

(10) Patent No.: US 11,447,959 B2
(45) Date of Patent: Sep. 20, 2022

(54) MASONRY VENEER HANGER AND SPACER

(71) Applicants: David R. Orcutt, Greenleaf, ID (US); David R. Orcutt, Jr., Greenleaf, ID (US)

(72) Inventors: David R. Orcutt, Greenleaf, ID (US); David R. Orcutt, Jr., Greenleaf, ID (US)

(73) Assignee: Orcutt Innovations, LLC, Greenleaf, ID (US)

( * ) Notice: Subject to any disclaimer, the term of this patent is extended or adjusted under 35 U.S.C. 154(b) by 0 days.

(21) Appl. No.: 16/880,041

(22) Filed: May 21, 2020

(65) Prior Publication Data

US 2020/0370303 A1 Nov. 26, 2020

Related U.S. Application Data

(60) Provisional application No. 62/850,947, filed on May 21, 2019.

(51) Int. Cl.
*E04F 13/08* (2006.01)

(52) U.S. Cl.
CPC ..... *E04F 13/0835* (2013.01)

(58) Field of Classification Search
CPC ..... E04F 13/0835; E04F 13/24; E04F 13/141; E04F 13/147; B32B 23/0056; B32B 23/005; E04C 1/41
USPC ..... 264/475, 41, 46.6, 256, 267; 52/742.1, 52/105, 405.3
See application file for complete search history.

(56) References Cited

U.S. PATENT DOCUMENTS 990,209 A * 4/1911 MacKenzie ..... F16B 15/04 411/461
4,296,580 A * 10/1981 Weinar ..... E04B 2/7457 52/281
4,439,970 A * 4/1984 Rosner ..... E04F 13/0816 411/461
4,833,854 A * 5/1989 Paul ..... E04B 9/242 52/506.06
5,311,714 A * 5/1994 Passeno ..... E04F 13/0801 52/314
6,367,220 B1 * 4/2002 Krause ..... E04F 13/0864 52/512
6,640,516 B1 * 11/2003 Thompson ..... E04B 1/2608 52/712
7,398,623 B2 * 7/2008 Martel ..... E04B 5/12 411/461
7,444,717 B2 * 11/2008 Liu ..... F16B 5/0635 24/1
7,559,519 B1 * 7/2009 Dragic ..... E04B 2/7457 248/216.1
7,617,648 B2 * 11/2009 Moody ..... E04B 2/7457 52/481.1
8,033,069 B2 * 10/2011 Hotchkiss, III ..... E04F 13/0885 52/405.3
8,677,718 B2 * 3/2014 Marshall ..... E04D 13/1681 52/655.1
9,587,398 B1 * 3/2017 Attebery, II ..... E04B 2/965
(Continued)

*Primary Examiner* — Beth A Stephan
(74) *Attorney, Agent, or Firm* — Hogaboam Law Offices, PLLC; Romney J. Hogaboam, Esq.

(57) ABSTRACT

A hanger for attaching veneer to a surface and space the veneer away from the surface to permit moisture to escape. The hanger contains features around which veneer material adheres during curing and features for attaching the hanger to a surface.

17 Claims, 5 Drawing Sheets

(56) References Cited

U.S. PATENT DOCUMENTS

| | | | | |
|---|---|---|---|---|
| 10,428,532 | B2 * | 10/2019 | Smart | E04F 13/0894 |
| 10,597,865 | B2 * | 3/2020 | Erlebach | E04B 1/40 |
| 10,633,853 | B2 * | 4/2020 | Erlebach | A47K 3/405 |
| 10,801,537 | B2 * | 10/2020 | Getsiv | F16B 7/0473 |
| 2003/0066259 | A1 * | 4/2003 | Sudweeks | E04F 13/185 52/506.05 |
| 2004/0216408 | A1 * | 11/2004 | Hohmann, Jr. | E04B 1/4178 52/426 |
| 2007/0209308 | A1 * | 9/2007 | Barrett | E04F 13/147 52/506.05 |
| 2011/0175255 | A1 * | 7/2011 | Wernette | B28B 7/007 264/271.1 |
| 2013/0312356 | A1 * | 11/2013 | Foral | E04F 13/0837 52/588.1 |
| 2016/0108623 | A1 * | 4/2016 | Attebery, II | E04F 13/141 52/302.1 |
| 2016/0168865 | A1 * | 6/2016 | Pervan | B32B 5/14 52/309.1 |

* cited by examiner

MASONRY VENEER HANGER AND SPACER

CROSS-REFERENCE TO RELATED APPLICATIONS

This application claims priority to Provisional Application 62/850,947 filed on May 21, 2019.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

Not Applicable

STATEMENT REGARDING PRIOR DISCLOSURES BY AN INVENTOR OR JOINT INVENTOR

Not Applicable

BACKGROUND OF THE INVENTION

The present invention relates to stone panel wall construction devices and techniques. Stone masonry can be expensive because installing it can be labor intensive requiring craftsman with specialized knowledge and experience and the materials may be costly. Stone masonry also may not have insulating properties as advantageous as other materials. Remodeling to use traditional stone masonry on an existing structure can require substantial demolition and re-work.

Stone veneer is commonly used to give the appearance of stone masonry construction at lower material and labor cost than traditional stone masonry construction. Applying a stone veneer to an existing wall may require minimal, if any, modification to an existing wall while significantly changing the appearance. Stone veneer may often be installed relatively quickly since a single piece of veneer may have the appearance of multiple pieces of stone. It may also be installed using a different technique than traditional stone masonry which may be faster.

When a stone veneer is applied to an existing wall, it is generally installed using either mortar or a mortar-less technique. When mortar is used, it may be in addition to other attachment techniques or by itself. When it is used by itself, the surface must generally be rough to allow mortar to adhere to the wall. Additional material, such as chicken wire, may be attached to the surface to increase the adherence of the mortar to the surface. When used in addition to other attachment techniques, a stone veneer may be attached to a wall. Then gaps may be filled with mortar. This mortar may be merely decorative or may also serve to further secure the veneer to the wall.

Natural or artificial stone may be installed using non-traditional techniques to reduce the cost. Natural stone may be installed as a cladding. Traditional cladding techniques involve attaching relatively thin pieces of stone to a wall using brackets. Bracketless techniques generally use mortar or other cement. The surface is prepared to allow the mortar or cement to adhere to the surface. Mortar or cement is spread on the surface. Courses of stone are then installed in front of the surface with no space between the mortar or cement spread on the surface and the back of the stone.

Natural or artificial stone may also be installed using brackets which are attached directly to the back of stone pieces using anchors. These anchors may be attached to the stone pieces by drilling holes in the stone, placing the anchor in the stone, and securing the anchor to the stone with a mechanical expander or cement. Alternatively, brackets may attach to features, such as grooves or bevels, on the edges of the stone pieces. In this technique, mortar may or may not be used.

Artificial stone is also used at times for various reasons. Depending on the material used in its construction, artificial stone may be substantially less dense. By being less dense (lighter), a wall to which artificial stone is attached may require less reinforcement than if heavier natural stone was used. Artificial stone may also be significantly more uniform, at lower cost, than natural stone. The uniform shape may contribute to lower installation labor costs by making stones interchangeable and thereby reducing/eliminating sorting and searching time to find stones to fit in specific positions. Artificial stone may be manufactured at a desirable location reducing transportation costs. Artificial stone may also be consistently colored to meet specific requirements. The color may be blended into the material from which the artificial stone is made thereby preventing color from wearing off the stone material.

One problem common to veneer systems is the introduction of water and moisture between the veneer and surface. When moisture becomes trapped between the veneer and surface, mold can form damaging and discoloring the veneer and potentially causing rot and structural damage to the surface. If freezing and thawing cycles occur, the veneer may be forced away from the surface to which the veneer is attached causing damage to the veneer and eventually breaking the veneer away from the surface.

DESCRIPTION OF RELATED ART INCLUDING INFORMATION DISCLOSED UNDER 37 CFR 1.97 AND 37 CFR 1.98

Not Applicable

BRIEF SUMMARY OF THE INVENTION

An apparatus for attaching faux stone to a surface and space the faux stone away from the surface to permit moisture to escape.

DETAILED DESCRIPTION OF THE INVENTION

Figure 1:
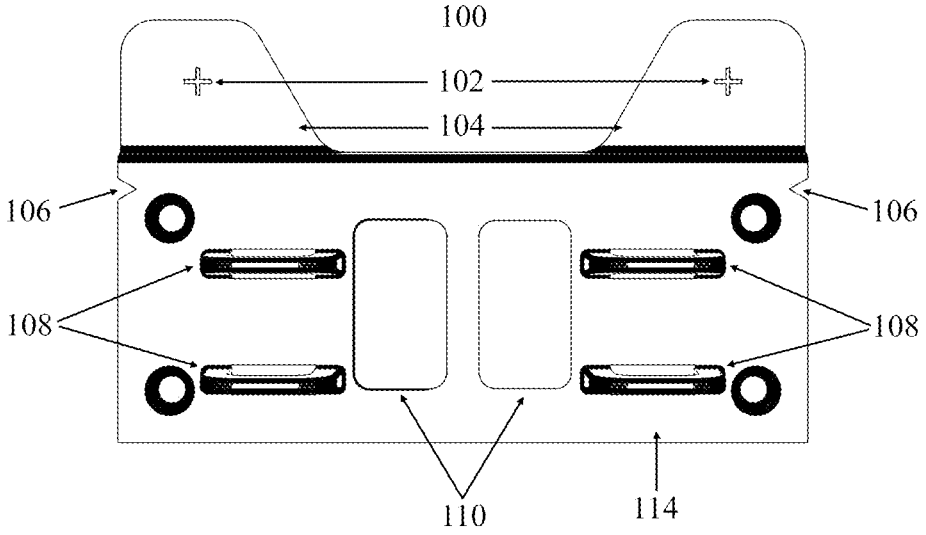
FIG. 1 shows a front perspective view of a hanger of the present invention.
Figure 2:
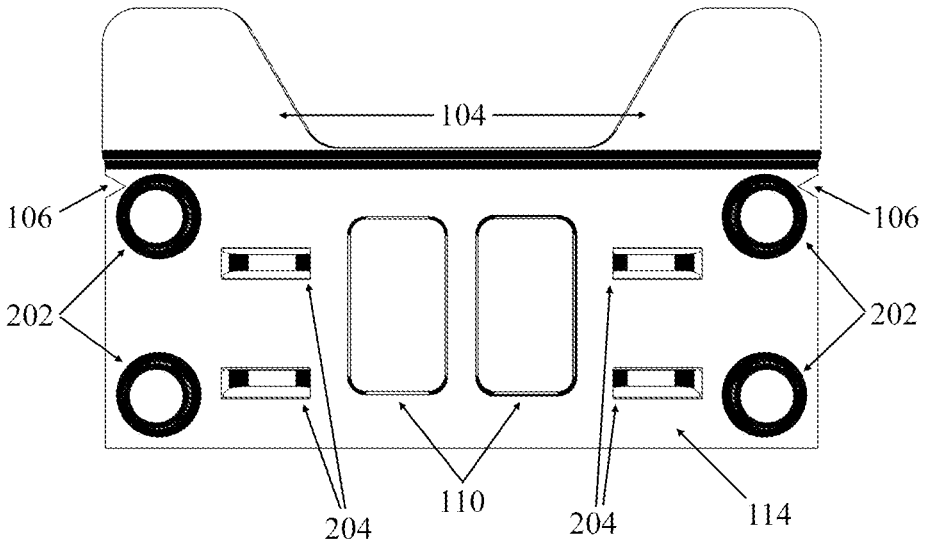
FIG. 2 shows a rear perspective view of a hanger of the present invention.
Figure 3:
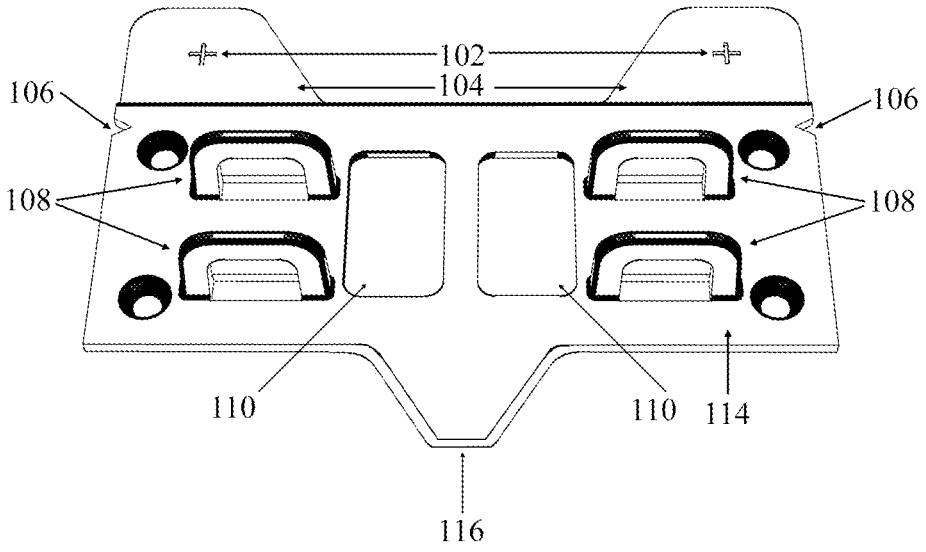
FIG. 3 shows a bottom perspective view of a hanger of the present invention.
Figure 4:
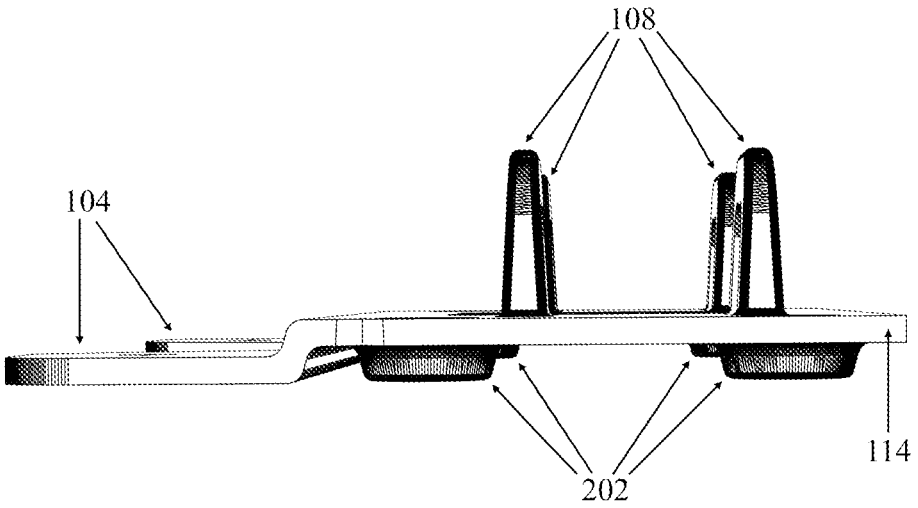
FIGS. 4 and 5 show a side edge perspective view of a hanger of the present invention.
Figure 5:
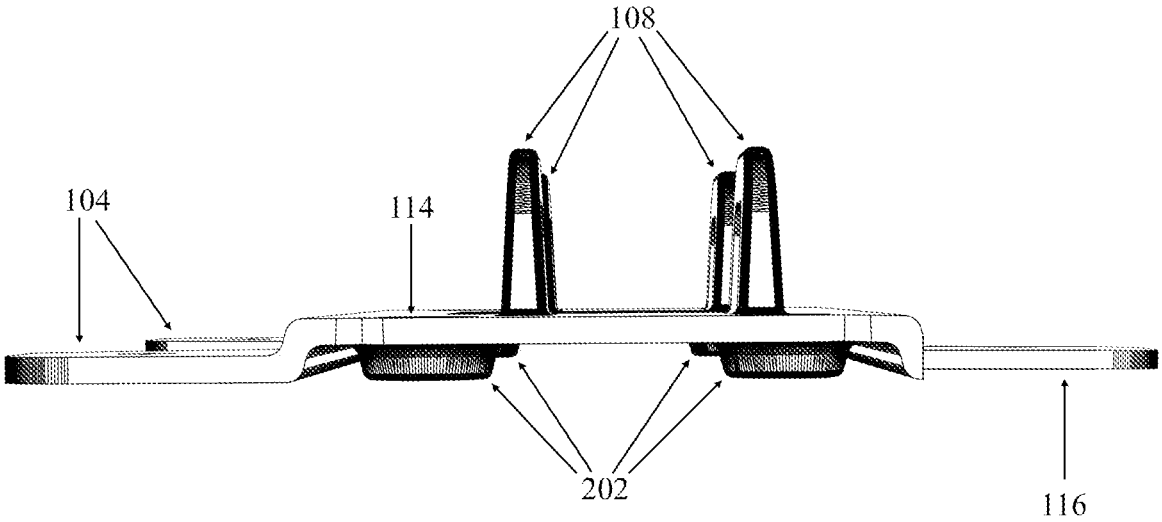

The present invention is a hanger 100 for installing artificial stone veneer on a wall. The hanger 100 comprises a body member 114. In a preferred embodiment, the body member is s-generally a rectangular prism which is thin relative to its width and height. In certain embodiments, the body member 114 extends above, below, or to either or both sides of a piece of artificial stone veneer to which the veneer is attached.

In a preferred embodiment, the front of the body member 114 contains one or more veneer attachment protrusion(s) 108 which extend away from the body member 114. The veneer attachment protrusion(s) 108 is/are configured to be attached to a piece of artificial stone veneer. In a preferred embodiment, the veneer attachment protrusion(s) 108 is/are rounded with open centers, approximating the shape of a d-ring. In an alternative embodiment, the veneer attachment protrusion(s) do not have an opening but rather are thicker at some portion further from the body member 114 than nearer the body member 114. In another alternative embodiment, the veneer attachment protrusion(s) are curved in a corkscrew shape. In other embodiments, the veneer attachment protrusion(s) are other shapes which resist the separation of the veneer from the body member 114 when the veneer has adhered to the veneer attachment protrusion(s) 108.

In a preferred embodiment, the body member 114 contains one or more holes 110, referred to as witness holes, passing through from front to back. In a preferred embodiment, the witness holes 110 align with the veneer attachment protrusion(s) 108. The witness holes 110 are configured to aid in the installation of the hanger 100 into the veneer. In a preferred process, a mold is filled with liquid veneer material to approximately a predefined level. The hanger 100 is then placed over the mold with the veneer attachment protrusion(s) 108 facing the open top of the mold containing the veneer material. The hanger 100 is then pressed into the veneer material. The depth of the veneer attachment protrusion(s) 108 in the veneer material is visible through the witness hole(s) 110. The fill volume of the veneer material can very to a degree as long as it is sufficient for the veneer material to cover the end(s) of the veneer attachment protrusion(s) 108 as the veneer material cures. In certain embodiments, witness holes 204 are located immediately behind veneer attachment protrusion(s) 108.

In a preferred embodiment, the hanger 100 is further configured with alignment features 106. These alignment features (mold alignment features) 106 are configured to align with features of the mold when the hanger 100 is installed in the veneer material. In an alternative embodiment, the alignment features 106 are configured to align with features of a jig and/or other member which holds the veneer mold. The alignment features 106 facilitate the consistent placement of the hanger in relation to the veneer pieces. In an alternative embodiment, the hanger is configured with alignment features (installation alignment features) 106 configured to indicate placement of an additional course of veneer to aid in consistent spacing between courses of veneer. The mold alignment features 106 and installation alignment features 106 may be the same or may be distinct.

In a preferred embodiment, the back face of the body member 114 is configured with one or more spacing member(s) 202. The spacing member(s) 202 is/are configured to, when the hanger 100 is installed on a surface, prevent the body 114 of the hanger 100 from directly contacting the surface. By preventing the body 114 of the hanger 100 from resting against the surface, a gap is thereby formed which allows water to easily drain from between the veneer and surface. The gap further allows air to flow between the surface and the veneer drying the space thereby mitigating the risk of mold and freezing damage. In a preferred embodiment, the spacing member(s) 202 is/are approximately circular cylinders. In a preferred variation of this preferred embodiment, the spacing members 202 are at least partially hollow.

In certain embodiments, the hanger further comprises one or more surface attachment member(s) 104. The surface attachment member(s) 104 are attached to the body member 114. In a preferred embodiment, the surface attachment member(s) 104 have a front and back. In a preferred embodiment, the back of the surface attachment member(s) 104 lie in approximately the same plane as the portion of the spacing member(s) 202 configured to contact the surface. In a preferred embodiment, the surface attachment members 104 are further configured with marks 102 which indicate one or more preferred attachment location points where it is recommended the surface attachment member 104 should be attached to the surface. In a preferred embodiment, the surface attachment member(s) 104 do not contain one or more hole(s) for one or more nails or screws to pass through when attaching the surface attachment member(s) 104 to the surface. In a preferred embodiment, the material from which the hanger 100 is constructed is selected such that a brad, staple, screw, nail, or other attachment means of small to moderate size does not split the hanger 100 when inserted through the surface attachment member(s) 104 of the hanger 100. In certain embodiments, features of the surface attachment member(s) 104 are configured to interact with features of the body member 114 to assure consistent spacing between adjacent courses of facade.

In embodiments where the body member 114 extends beyond the piece of veneer to which the hanger is attached, the portion of the body member which extends beyond the piece of veneer may serve as a spacer or support for an adjacent piece of veneer.

If suspended from the top, and not adequately supported along the height of the veneer, a course of veneer may tip down with the bottom closer to the surface and the top further from the surface than desired. This is most likely to occur with the bottom course. In order to support the veneer toward the bottom, a hanger 100 may be configured without one or more surface attachment members 104 such that the spacing members 202 provide support to aid in keeping the veneer vertical.

In certain embodiments, the thickness of the surface attachment member(s) 104 is reduced in the area of the hanger 100 intended for the attachment means. When the thickness of the surface attachment member 104 is reduced, the reduction in thickness is selected such that the top of the attachment means does not extend beyond the surface of the adjacent surface attachment means when installed.

In certain embodiments, the hanger 100 has additional holes 110 in the body, surface attachment member, and/or spacing member(s). These additional holes 110 reduce the amount of material in the hanger reducing materials cost and weight. These additional holes 110, in whole or in part, may also function as alignment features.

In a preferred process of using the hanger 100, an artificial stone mold is placed on a surface with the desired amount of slope/tilt (or lack thereof). This mold may replicate the features of one or more pieces of stone. The mold is then filled with liquid artificial stone material. A hanger 100 is then aligned, using alignment features 106 on the hanger 100, with one or more features of the mold. The hanger 100 is then pressed into the mold to a desired depth. The desired depth may be controlled by the mold, by a jig, or other means to achieve a consistent and desired distance between the bottom of the mold and back of the hanger 100. In an alternative process, the hanger 100 is positioned and then the mold is filled with liquid artificial stone material. The liquid artificial stone material is then allowed to cure.

In a preferred process, the hanger 100 is used to install artificial stone veneer on a surface in the following way. If desired, the surface is marked with one or more horizontal marks to allow alignment features 106 of the hangers 100 or veneer sections to be aligned on those marks. Starting at the bottom of the surface to which the veneer is to be installed, a first piece of veneer is placed against the surface. A staple gun is placed against the surface attachment member 104. The staple gun is activated causing a staple to be inserted through the surface attachment member 104 into the surface. In an alternative embodiment, a nail, brad, or screw is used in place of a staple. Various means used to secure the surface attachment member 104 to the surface are within the scope of the present invention. A second piece of veneer is placed beside the first of veneer at approximately the same height where the height is set using alignment features 106 of the hanger 100 and marks on the surface. Additional pieces of veneer are attached to the surface to complete a first (bottom) course. A second course is then installed further up the surface with the desired separation, or lack there of, between the first (bottom) and second courses. In a preferred method, the pieces of veneer in the second course is horizontally offset some amount from the pieces of veneer in the first course. Features of the veneer sections may cause them to interlock at a particular offset with veneer sections above and below a particular piece of veneer.

In certain embodiments, the hangers 100 of adjacent courses are configured to interlock. In this embodiment, the top of the hanger 100 is configured with a feature to accept features from a later-installed hanger 100 from the next higher course of veneer. In a preferred embodiment, this feature is a space between the body of the hanger and the surface when the hanger is attached to the surface. In a preferred embodiment the feature of a later-installed hanger 100 from the next higher course of veneer is an extension 116 which is configured to fit between the body 114 of the hanger 100 and the surface. In alternative embodiments of this embodiment, the hangers 100 interlock horizontally instead of, or addition to, vertically. Interlocking features may be provided by a plurality of hanger pieces when desired.

For purposes of this application, including claims, "substantially solid" means a surface which is rigid and which prevents the passage of articles the apparatus is designed to store and dispense.

For purposes of this application, including claims, "plurality" means one or more.

For purposes of this application, including claims, "series" means one or more.

For purposes of this application, including claims, "veneer" means stone, aggregate veneer, tile, wood, and any other relatively thin material mounted on a surface for decorative, aesthetic, or other non-structural purpose.

The invention claimed is:

1. An apparatus for attaching veneer to a surface comprising:

A) a substantially flat body member,

B) a plurality of substantially flat features configured to accept means for attaching said body member to the surface, C) a plurality of means, integral with said body member, for attaching said body member to a piece of veneer, and D) a plurality of standoff features, configured to prevent the substantially flat body member from contacting the surface, attached to said body member extending away from said body member to a plane defined by said plurality of features configured to accept means for attaching said body member to the surface.

2. The apparatus of claim 1 wherein:

A) said body member and said plurality of features configured to accept means for attaching said body member to a surface are not co-planar.

3. The apparatus of claim 2 further comprising:

A) an extension configured to extend beyond said piece of veneer in a direction other than that of said plurality of substantially flat features configured to accept means for attaching said body member to a surface.

4. The apparatus of claim 3 wherein said extension is configured:

A) to fit between a previously installed piece of veneer and the surface.

5. The apparatus of claim 4 wherein said extension is configured:

A) to fit between said plurality of substantially flat features configured to accept means for attaching said body member to a surface of an apparatus of an adjacent piece of veneer.

6. The apparatus of claim 4 wherein said extension is configured:

A) to fit between a plurality of apparatus of an adjacent piece of veneer.

7. The apparatus of claim 2 further comprising:

A) a plurality of indexing features configured to align said apparatus with a plurality of features of a veneer mold.

8. The apparatus of claim 2 further comprising:

A) a plurality of indexing features configured to align said apparatus when said apparatus is installed on a surface.

9. The apparatus of claim 2 wherein said plurality of features configured to accept means for attaching said body member to a surface further comprise:

A) a plurality of features indicating a desirable location for placing means for attaching said body member to a surface.

10. The apparatus of claim 9 where said features indicating a desirable location for placing means for attaching said body member to a surface comprise:

A) holes.

11. The apparatus of claim 9 where said features indicating a desirable location for placing means for attaching said body member to a surface comprise:

A) marks which do not pass through the entire thickness of said plurality of features configured to accept means for attaching said body member to a surface.

12. The apparatus of claim 2 wherein:

A) said standoff features extend away from said body member a distance at least as great as a thickness of said plurality of substantially flat features configured to accept means for attaching said body member to a surface.

13. The apparatus of claim 12 further comprising:

A) a plurality of voids in said body member adjacent said plurality of means, integral with said body member, for attaching said body member to a piece of veneer.

14. The apparatus of claim 13 wherein said plurality of means, integral with said body member, for attaching said body member to a piece of veneer further comprise:

A) a plurality of projections which are not smooth where said projections are configured to interface with a piece of veneer.

15. The apparatus of claim 13 wherein said plurality of means, integral with said body member, for attaching said body member to a piece of veneer further comprise:

A) a plurality of projections which are threaded where said projections are configured to interface with a piece of veneer.

16. The apparatus of claim 13 wherein said plurality of means, integral with said body member, for attaching said body member to a piece of veneer further comprise:

A) a plurality of open loops.

17. The apparatus of claim 2 wherein:

A) said body member is configured to extend beyond said piece of veneer and is configured to space a plurality of adjacent pieces of veneer away from said surface.

* * * * *